US009730567B2

(12) United States Patent
Rimoshytus

(10) Patent No.: US 9,730,567 B2
(45) Date of Patent: Aug. 15, 2017

(54) CLEANING GLOVE

(71) Applicant: James Ryan Rimoshytus, Warren, RI (US)

(72) Inventor: James Ryan Rimoshytus, Warren, RI (US)

( * ) Notice: Subject to any disclaimer, the term of this patent is extended or adjusted under 35 U.S.C. 154(b) by 170 days.

(21) Appl. No.: 14/543,331

(22) Filed: Nov. 17, 2014

(65) Prior Publication Data

US 2015/0136177 A1 May 21, 2015

Related U.S. Application Data

(60) Provisional application No. 61/904,928, filed on Nov. 15, 2013.

(51) Int. Cl.

| | |
|---|---|
| ***B08B 7/00*** | (2006.01) |
| ***A47L 13/18*** | (2006.01) |
| ***A47L 13/12*** | (2006.01) |
| ***A47L 13/02*** | (2006.01) |

(52) U.S. Cl.

CPC ..... *A47L 13/18* (2013.01); *A47L 13/02* (2013.01); *A47L 13/12* (2013.01)

(58) Field of Classification Search

CPC ..... A47L 13/02; A47L 13/18; A47L 13/12
USPC ..... 134/93, 6, 201; 15/118
See application file for complete search history.

(56) References Cited

U.S. PATENT DOCUMENTS 5,644,796 A * 7/1997 Laughlin ..... A41D 19/01594 2/160
2008/0271224 A1* 11/2008 Wilbert ..... A41D 19/01523 2/161.1

* cited by examiner

*Primary Examiner* — Eric Golightly

(57) ABSTRACT

A cleaning glove is provided. The cleaning glove is made of leather and may be tanned. The cleaning glove includes an outside surface and an inside surface. The inside surface is formed to receive a hand of a user. The body portion may further include a first side forming a thumb portion and a second side opposite the first side. The present invention includes at least a first side scraper attached to the second side of the body portion. The side scraper includes a rigid material.

11 Claims, 1 Drawing Sheet

CLEANING GLOVE

CROSS-REFERENCE TO RELATED APPLICATION

This application claims the benefit of priority of U.S. provisional application No. 61/904,928, filed Nov. 15, 2014, the contents of which are herein incorporated by reference.

BACKGROUND OF THE INVENTION

The present invention relates to gloves and, more particularly, to a leather cleaning glove for removing pet hair.

Certain devices, such as vacuums, brushes, and rubber mitts are used to clean the inside of cars and other fabric surfaces. A vacuum cleaner is a device that uses an aft pump to create a partial vacuum to suck up dust and dirt, usually from floors, and optionally from other surfaces as well. The dirt is collected by either a dust bag or a cyclone for later disposal. Vacuums require emptying and are not very portable. Brushes and rubberized mitts require picking hair from the bristles and have specific limited uses.

As can be seen, there is a need for an improved cleaning device for cleaning pet hair from fabric surfaces including car interiors and like fabric surfaces.

SUMMARY OF THE INVENTION

In one aspect of the present invention, a cleaning glove comprises: a body portion comprising leather and having an outside surface and an inside surface, wherein the inside surface is formed to receive a hand of a user, wherein the body portion further comprises a first side forming a thumb portion, and a second side opposite the first side; and a first side scraper attached to the second side of the body portion and comprising a rigid material.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a pair of brushed, tanned cowhide leather gloves/mittens used to remove loose, shedding pet hair from pets and various fabric surfaces including, but not limited to furniture, some clothing, carpeted surfaces, fabric upholstered pieces and motor vehicle interiors and the like. The present invention quickly and easily removes loose, shedding pet hair from pets and fabric surfaces just by swiping the gloved hands over an affected area, gathering the hair and disposing of it. The gloves are portable, require no picking of hair from bristles, no sticky surfaces to deal with, no buying refills, have many uses beyond pet hair removal, require no emptying, and are not noisy or cumbersome. The present invention may be used on pets and multiple fabric surfaces, may be available in various colors, designs, and sizes, and may be washable.

Figure 1:
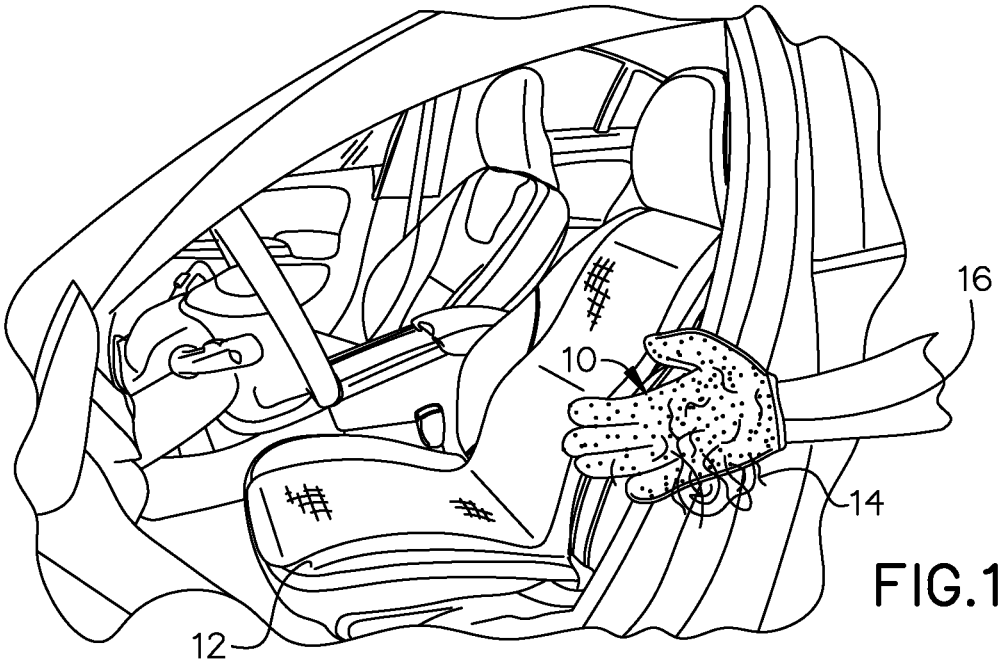
FIG. 1 is a perspective view of the present invention shown in use.
Figure 2:
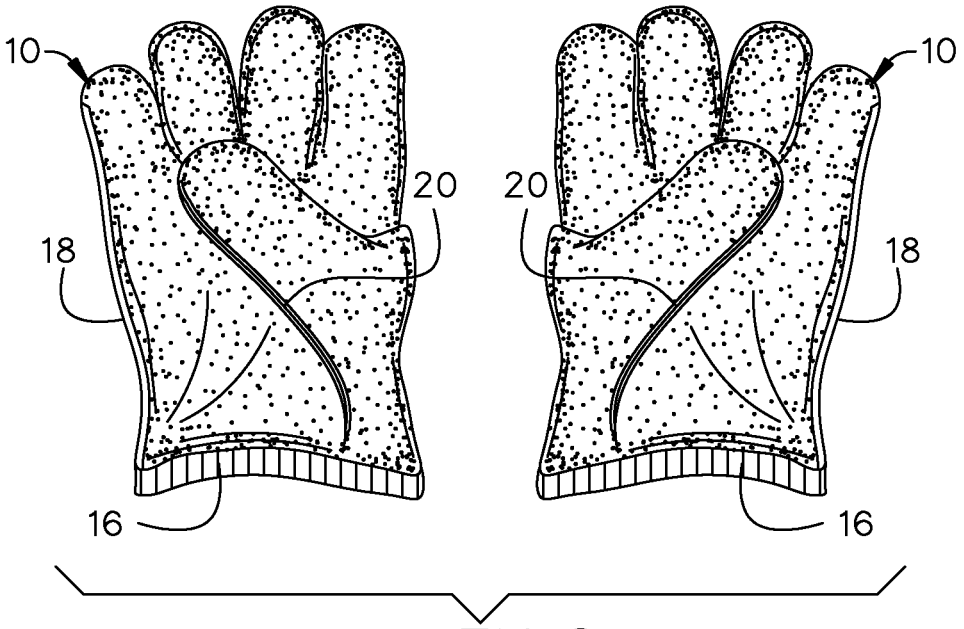
FIG. 2 is a perspective view of the present invention.

Referring to FIGS. 1 and 2, present invention provides a cleaning glove 10. The cleaning glove 10 is made of leather and may be tanned. The cleaning glove 10 includes an outside surface and an inside surface. The inside surface is formed to receive a hand of a user. The body portion may further include a first side forming a thumb portion and a second side opposite the first side. The present invention includes at least a first side scraper 18 attached to the second side of the body portion. The side scraper 18 includes a rigid material.

The glove 10 of the present invention may be shaped like a normal glove or mitt. For example, the glove 10 may include five fingers with finger cavities to fit the fingers of a user within. The glove 10 may be made for both the right and left hand. The first side of the glove 10 may include a seam that runs from the wrist of the glove 10 up to the top of the thumb portion. The second side of the glove 10 may include a seam that runs from the wrist of the glove 10 up to the top of the pinky portion.

The side scraper 18 of the present invention may be used to scrape dust and hair 14. In certain embodiments, the side scraper 18 may be made of a rigid material that is more rigid than the body, such as stiff leather and plastic. In certain embodiments, the present invention may include a second side scraper 20 attached to the first side of the body portion 10. Therefore, the second side scraper 20 may run from the base to the top of the thumb.

In certain embodiments, the glove 10 of the present invention may include an elastic wrist band 16. The plastic wrist band 16 may line the opening of the glove 10 and may further secure the glove 10 to the user's hand.

A method of using the present invention may include the following: placing the cleaning glove 10 over a hand; placing the cleaning glove 10 onto a fabric material 12 comprising dust and hair 14; and swiping a fabric material 12 with the cleaning glove 10, thereby removing the dust and hair 14. Clap the gloved hands together to remove any excess hair, repeat as necessary. The gloves provide a quick and efficient general removal of pet hair from fabric surfaces.

It should be understood, of course, that the foregoing relates to exemplary embodiments of the invention and that modifications may be made without departing from the spirit and scope of the invention as set forth in the following claims.

What is claimed is:

1. A cleaning glove comprising:

a body portion comprising leather and having an outside surface with a perimeter and an inside surface, wherein the inside surface is formed to receive a hand of a user, wherein the body portion further comprises a first side of the perimeter along a thumb portion, and a second side of the perimeter opposite the first side; and a first side scraper attached to the second side of the body portion and comprising a rigid material, wherein the second side of the body portion comprises a length from the wrist to the top of the pinky, and the first side scraper extends the length of the second side of the body portion from the wrist to the top of the pinky.

2. The cleaning glove of claim 1, further comprising finger cavities formed on the body portion and sized to receive fingers of the user.

3. The cleaning glove of claim 1, further comprising a second side scraper attached to the first side of the body portion.

4. The cleaning glove of claim 1, wherein the rigid material is at least one of a stiff leather and a plastic.

5. The cleaning glove of claim 1, further comprising an elastic wrist band.

6. A method of using a cleaning glove, the cleaning glove comprising: a body portion comprising leather and having an outside surface with a perimeter and an inside surface, wherein the inside surface is formed to receive a hand of a user, wherein the body portion further comprises a first side of the perimeter along a thumb portion, and a second side of the perimeter opposite the first side; and a first side scraper attached to the second side of the body portion and comprising a rigid material, wherein the second side of the body portion comprises a length from the wrist to the top of the pinky, and the first side scraper extends the length of the second side of the body portion from the wrist to the top of the pinky, the method comprising:

placing the cleaning glove over the hand;

placing the cleaning glove onto a fabric material comprising dust and hair; and swiping the fabric material with the cleaning glove, thereby removing the dust and hair.

7. A method of using a cleaning glove, the cleaning glove comprising: a body portion comprising leather and having an outside surface with a perimeter and an inside surface, wherein the inside surface is formed to receive a hand of a user, wherein the body portion further comprises a first side of the perimeter along a thumb portion, and a second side of the perimeter opposite the first side; and a first side scraper attached to the second side of the body portion and comprising a rigid material, wherein the second side of the body portion comprises a length from the wrist to the top of the pinky, and the first side scraper extends the length of the second side of the body portion from the wrist to the top of the pinky, the method comprising:

placing the cleaning glove over the hand;

placing the cleaning glove onto an animal having at least one loose hair; and swiping the cleaning glove across the animal, thereby removing the loose hair.

8. A cleaning glove comprising:

a first leather portion forming a perimeter substantially in the shape of a glove;

a second leather portion bound to the first leather portion along the perimeter to define five finger cavities including: a thumb cavity running along a first side of the perimeter and forming a first cavity tip; and a pinky cavity running along a second side of the perimeter opposite the first side to form a second cavity tip;

an opening formed within the perimeter between the first side and the second side to receive a hand between the first leather portion and the second leather portion; and a first side scraper formed from a rigid material and running along the second side of the perimeter from the opening to the second cavity tip.

9. The cleaning glove of claim 8, further comprising a second side scraper formed from a rigid material and running along the first side of the perimeter from the opening to the first cavity tip.

10. The cleaning glove of claim 9, wherein the rigid material of the first side scraper and the second side scraper is at least one of a stiff leather and a plastic.

11. The cleaning glove of claim 9, further comprising an elastic wrist band affixed around the opening.

* * * * *